United States Patent [19]

Munekata et al.

[11] 4,288,945

[45] Sep. 15, 1981

[54] REST APPARATUS

[75] Inventors: Kenichi Munekata, Kariya; Michio Fujita; Yasuhiro Hattori, both of Nagoya, all of Japan

[73] Assignee: Toyoda Koki Kabushiki Kaisha, Kariya, Japan

[21] Appl. No.: 98,743

[22] Filed: Nov. 30, 1979

[30] Foreign Application Priority Data

Dec. 8, 1978 [JP] Japan ..... 53-152196

[51] Int. Cl.[3] ..... B24B 41/06

[52] U.S. Cl. ..... 51/238 S; 51/105 R

[58] Field of Search ..... 51/105 R, 238 R, 238 S

[56] References Cited

U.S. PATENT DOCUMENTS

| | | | |
|---|---|---|---|
| 1,471,281 | 10/1923 | Ries | 51/238 S |
| 3,076,296 | 2/1963 | Joyce | 51/238 S |
| 3,736,114 | 5/1973 | Okada | 51/238 S |
| 3,852,920 | 12/1974 | Takida | 51/105 R |
| 3,878,651 | 4/1975 | Nakada | 51/238 S |

*Primary Examiner*—Harold D. Whitehead

*Attorney, Agent, or Firm*—Oblon, Fisher, Spivak, McClelland & Maier

[57] ABSTRACT

A rest apparatus for supporting a cylindrical portion of a workpiece to be machined. A pilot shaft is supported at the opposite ends thereof by a support head and provided with a piston portion to form a hydraulic cylinder with a cylinder bore of a rest housing so as to move the rest housing toward and away from the workpiece. The axis of the pilot shaft passes through or slightly above the axis of the workpiece. Rotation of the rest housing about the pilot shaft is prevented. A pair of rest shafts are slidably but nonrotatably received in the rest housing for horizontally and vertically supporting the workpiece by a pair of rest shoes. Feed apparatus is operatively connected to the pair of rest shafts to feed the pair of rest shoes toward the center of the workpiece.

4 Claims, 4 Drawing Figures

PRIOR ART

REST APPARATUS

BACKGROUND OF THE INVENTION

1. Field of the Invention

The present invention relates to a rest apparatus movably guided and provided with a pair of rest shoes which contact and support a cylindrical workpiece to be machined.

2. Description of the Prior Art

In a conventional rest apparatus for a grinding machine, as shown in FIG. 1, a rest housing 3 having an upper shoe 1 and a lower shoe 2 is movably guided by a pair of horizontally parallel pilot shafts 4. The axes of the pilot shafts 4 are located at a position lower than the axis of a workpiece to be ground, so that the rest housing 3 receives a clockwise moment, as viewed in FIG. 1, by a grinding resistance exerted on the upper shoe 1 by a grinding wheel, not shown. The rest housing 3 also receives a counterclockwise moment, as viewed in FIG. 1, by the action of the lower shoe 2 supporting the weight of the workpiece.

Since the lower shoe 2 supports the weight of the workpiece, a substantially constant force is applied to the lower shoe 2. On the other hand, the upper shoe 1 supports a grinding resistance which is varied depending upon the grinding condition, that is, either a rough or fine grinding operation. Therefore, when the direction of the resultant moment caused by the upper and lower shoes 1 and 2 is reversed, the rest housing 3 is fluctuated, resulting in the lowering of the rigidity of the rest apparatus. In particular, the grinding resistance is lowered at the fine grinding operation, so that the rotary moment on the rest housing is reversed in direction when the grinding operation is changed from rough to fine, with the result of possible vibration mark on the workpiece being ground.

SUMMARY OF THE INVENTION

It is, therefore, an object of the present invention to provide a new and improved rest apparatus for supporting a cylindrical workpiece with high rigidity and stability.

Another object of the present invention is to provide a new and improved rest apparatus wherein a pilot shaft for slidably supporting a rest housing is arranged at a position where the axis thereof passes through or slightly above the axis of the workpiece.

A further object of the present invention is to provide a new and improved rest apparatus of the character set forth above, wherein the pilot shaft is provided with a piston portion to form a hydraulic cylinder with a cylinder bore of the rest housing so as to move the rest housing toward and away from the workpiece.

Briefly, according to the present invention, these and other objects are achieved by providing a rest apparatus for supporting a cylindrical workpiece to be machined. A support head is fixedly mounted on a base. A pilot shaft is supported at the opposite ends thereof by the support head and provided with a piston portion. The axis of the pilot shaft passes through or slightly above the axis of the workpiece. A rest housing has a cylinder bore to form a hydraulic cylinder with the piston portion of the pilot shaft so as to be moved toward and away from the workpiece. Means is provided to prevent rotation of the rest housing about the pilot shaft. A pair of rest shafts are slidably but non-rotatably received in the rest housing in parallel relationship with the pilot shaft. A pair of rest shoes are operatively connected to one ends of the pair of rest shafts for horizontally and vertically supporting the workpiece. Feed means is operatively connected to the pair of rest shafts for feeding the pair of rest shoes toward the center of the workpiece.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
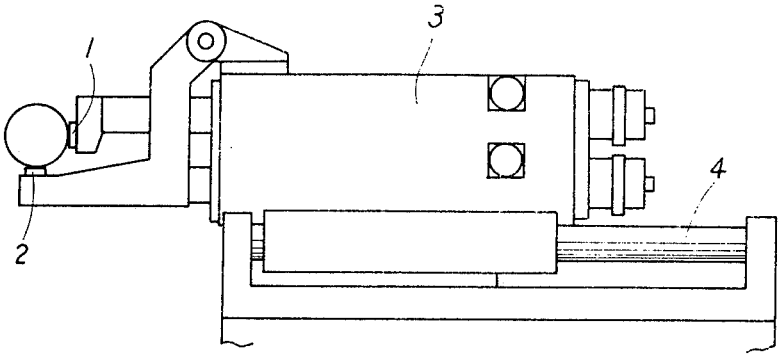
FIG. 1 shows a conventional rest apparatus.
Figure 2:
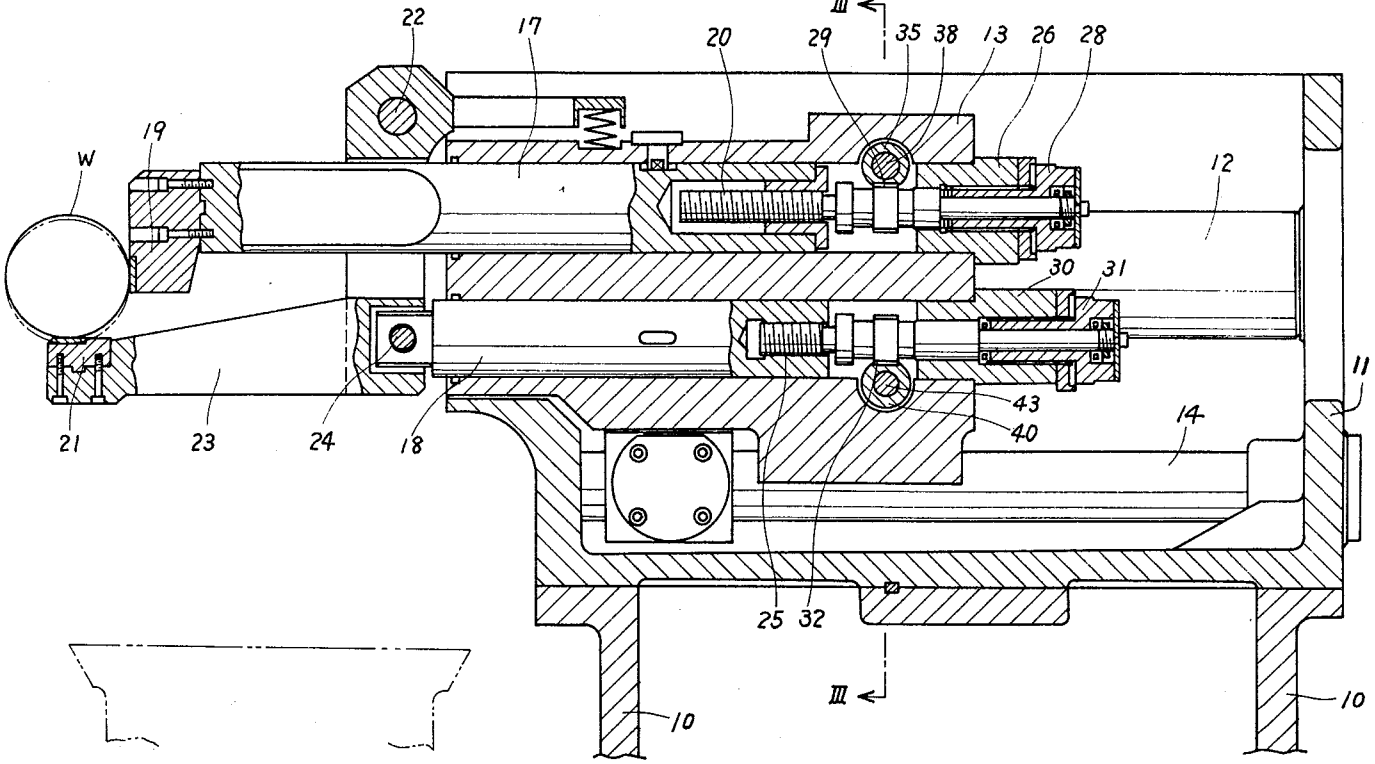
FIG. 2 is a sectional view of a rest apparatus according to the present invention.
Figure 3:
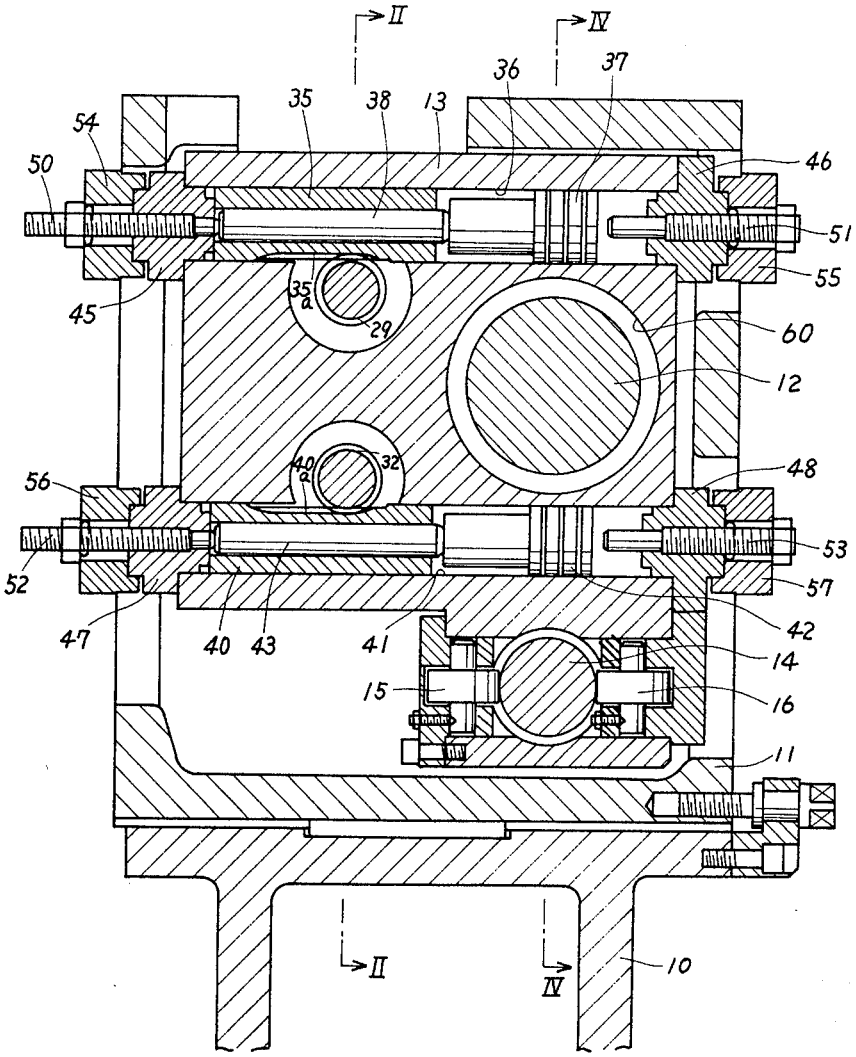
FIG. 3 is a sectional view taken along the lines III–III in FIG. 2.

Referring now to the drawings, wherein like reference numerals or characters refer to identical or corresponding parts throughout the several views, and more particularly to FIG. 2, there is shown a base 10 fixedly mounted on a bed of a grinding machine. A support head 11 is fixedly mounted on the top surface of the base 10. A pilot shaft 12 is supported at its opposite ends by the support head 11. The axis of the pilot shaft 12 passes through the axis of a cylindrical workpiece W to be ground. A rest housing 13 is supported by the pilot shaft 12 to be slidable toward and away from the workpiece W. A guide shaft 14 is supported at its opposite ends by the support head 11 in parallel relationship with the pilot shaft 12. As shown in FIG. 3, a pair of rollers 15 and 16 are rotatably supported by the rest housing 13 in such a manner as to contact the periphery of the guide shaft 14 to be guided along the axis of the guide shaft 14, thereby preventing rotation of the rest housing 13. A pair of rest shafts 17 and 18 are slidably but non-rotatably received in the rest housing 13 in vertically parallel relationship with the pilot shaft 12. The upper rest shaft 17 has secured, at its one end projected from the rest housing 13, an upper shoe 19 which is adapted to horizontally contact the periphery of the workpiece W to support the grinding resistance exerted thereon. The other end of the upper rest shaft 17 is in threaded engagement with one end of a screw shaft 20 within the rest housing 13. The lower rest shaft 18 is pivotably connected, at its one end projected from the rest housing 13, with an L-shaped arm 23 at its bend by a pin 24. The arm 23 is pivotably supported at its one end by the rest housing 13 by means of a pin 22. The other end of the arm 23 has secured thereto a lower shoe 21 which is adapted to be moved upward to vertically contact the periphery of the workpiece W to support the weight thereof. The other end of the lower rest shaft 18 is in threaded engagement with one end of a screw shaft 25 within the rest housing 13. The other end of the screw shaft 20 is rotatably but non-slidably received by an adjusting knob 28 which is in threaded engagement with a female screw member 26 secured to the rest housing 13. The screw shaft 20 has a pinion 29 at its middle portion. The other end of the screw shaft 25 is rotatably but non-slidably received by an adjusting knob 31 which is in threaded engagement with a female screw member 30 secured to the rest housing 13. The screw shaft 25 has a pinion 32 at its middle portion.

As shown in FIG. 3, a rack piston 35 in meshing engagement with the pinion 29 of the screw shaft 20 is slidably received in a cylinder bore 36 formed in the rest housing 13 in perpendicular relationship with the pilot shaft 12. A piston 37 is also slidably received in the cylinder bore 36 in tandem relationship with the rack piston 35. A piston rod 38 of the piston 37 is slidably received in the rack piston 35. A rack piston 40 in meshing engagement with the pinion 32 of the screw shaft 25 is slidably received in a cylinder bore 41 formed in the rest housing 13 in perpendicular relationship with the pilot shaft 12. A piston 42 is also slidably received in the cylinder bore 41 in tandem relationship with the rack piston 40. A piston rod 43 of the piston 42 is slidably received in the rack piston 40. End cap members 45 and 46 are secured to the opposite sides of the rest housing 13 to cover opposite ends of the cylinder bore 36. Stop bolts 50 and 51 are respectively screwed into the end cap members 45 and 46 to restrict the movement of the piston rod 38 and the piston 37. Adjusting knobs 54 and 55 are keyed to the stop bolts 50 and 51 to adjust the axial positions thereof, respectively. In a similar manner, end cap members 47 and 48 are secured to the opposite sides of the rest housing 13 to cover opposite ends of the cylinder bore 41. Stop bolts 52 and 53 are respectively screwed into the end cap members 47 and 48 to restrict the movement of the piston rod 43 and the piston 42. Adjusting knobs 56 and 57 are keyed to the stop bolts 52 and 53 to adjust the axial positions thereof, respectively.

Figure 4:
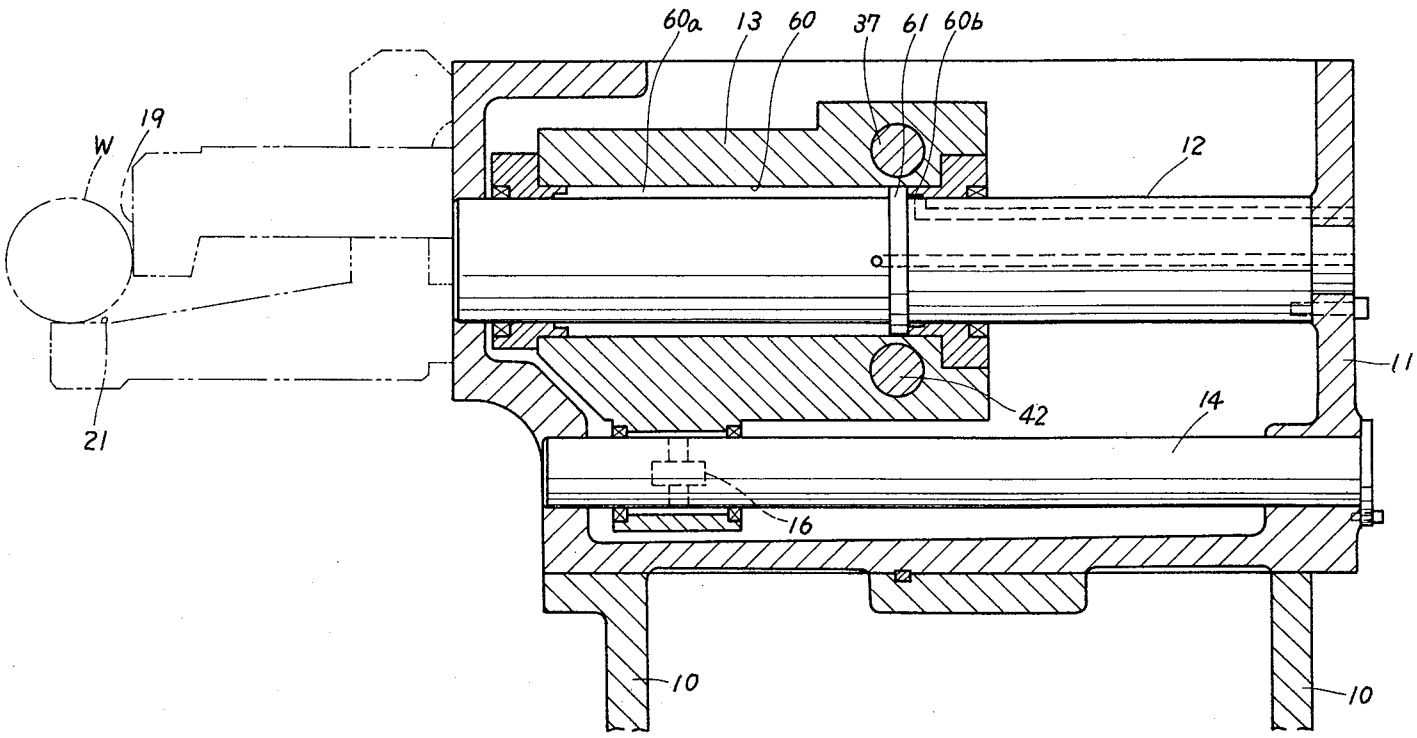
FIG. 4 is a sectional view taken along the lines IV—IV in FIG. 3.

As shown in FIG. 4, the rest housing 13 has a cylinder bore 60 in which a piston 61 formed on the pilot shaft 12 is slidably received to separate the cylinder bore 60 into two cylinder chambers **60*a* and 60*b*. Accordingly, supply of pressurized fluid into either of the cylinder chambers 60*a* and 60*b* causes the rest housing 13** to move toward and away from the workpiece W.

In operation, when pressurized fluid is supplied into the cylinder chamber **60*a*, the rest housing 13 is rapidly moved toward the workpiece W. When pressurized fluid is then supplied into the left chambers of the rack pistons 35 and 40 and into the right chambers of the pistons 37 and 42, the rack pistons 35 and 40 are moved to the right into abutting engagement with the shoulder portions of the piston rods 38 and 43, thereby advancing the rest shafts 17 and 18 through pinions 29 and 32 and the screw shafts 20 and 25. Since the workpiece W is deflected at its middle portion by its own weight, the lower shoe 21 is first engaged with the workpiece W to support the same during this movement of the rest shafts 17 and 18. Accordingly, the lower shoe 21 receives as a reaction a downward force perpendicular to its support surface so that a counterclockwise moment, as viewed in FIG. 2, is exerted on the rest housing 13. When the upper shoe 19 contacts the periphery of the workpiece W, the upper shoe 19 receives as a reaction a horizontal force perpendicular to its support surface. Since the contact point of the upper shoe 19 with the workpiece W is located in a horizontal plane including the axis of the pilot shaft 12, no clockwise moment, as viewed in FIG. 2, is exerted on the rest housing 13. This condition is not changed regardless of the grinding condition, that is, either in a rough grinding operation wherein a relatively large grinding resistance is exerted on the upper shoe 19 or in a fine grinding operation wherein a relatively small grinding resistance is exerted on the upper shoe 19. Accordingly, the rest housing 13 receives a rotational moment in a constant direction, so that the rest housing 13 is smoothly guided by the pilot shaft 12**, with the result of high rigidity.

Subsequently, the right chambers of the pistons 37 and 42 are exhausted so that the rack pistons 35, 40 and the pistons 37, 42 are bodily moved, respectively to the right, as viewed in FIG. 3. Accordingly, the upper and lower shoes 19 and 21 are moved toward the workpiece W at a predetermined feed speed.

In the above-described embodiment, the axis of the pilot shaft 12 passes through the axis of the workpiece W. However, location of the pilot shaft 12 above the axis of the workpiece permits the rest housing 13 to receive the rotary moment by the upper shoe 19 in the same direction as that by the lower shoe 21 regardless of the grinding condition, which can thus pervent the fluctuation of the rest housing to thereby avoid the vibration mark on the workpiece. Nevertheless, it is not desirable to locate the pilot shaft too away from the axis of the workpiece, since the counterclockwise moment which the rest housing 13 receives is considerably increased to increase the bending stress of the pilot shaft 12. Accordingly, it is desirable to locate the pilot shaft 12 slightly above the axis of the workpiece.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A rest apparatus for supporting a cylindrical portion of a workpiece to be machined comprising:

a base;

a support head fixedly mounted on said base;

a pilot shaft supported at the opposite ends thereof by said support head and provided with a piston portion;

a rest housing having a cylinder bore to form a hydraulic cylinder with said piston portion of said pilot shaft so as to be moved toward and away from the workpiece;

a guide shaft supported at opposite ends thereof by said support head in vertically parallel relationship with said pilot shaft for guiding said rest housing;

a pair of rest shafts slidably but non-rotatably received in said rest housing in parallel laterally offset relationship with said pilot shaft;

a pair of rest shoes operatively connected to one of the ends of said pair of rest shafts for horizontally and vertically supporting the workpiece, a first one of said rest shoes including a first support area for the horizontal support of said workpiece and a second one of said rest shoes including a second support area for the vertical support of said work, said first support area being adapted to support said workpiece in a horizontal plane located in a range extending from the axis of said workpiece to the vertical height immediately above said axis; and feed means operatively connected to said pair of rest shafts for feeding said pair of rest shoes toward the center of the workpiece, wherein the axis of said pilot shaft is in a horizontal plane which lies between said rest shafts and intersects said first support area.

2. A rest apparatus as claimed in claim 1, further comprising:

a pair of rollers rotatably supported by said rest housing in such a manner as to contact the periphery of said guide shaft to be guided thereby along the axis thereof.

3. A rest apparatus as claimed in claim 1 or 2, wherein said feed means comprises:

a screw shaft in threaded engagement at one end thereof with the other end of one of said rest shafts and rotatably but non-slidably received at the other end thereof by said rest housing;

a pinion formed on the middle portion of said screw shaft;

said rest housing having a cylinder bore in perpendicular relationship with said pilot shaft;

a pair of end cap members secured to the opposite sides of said rest housing to cover opposite ends of said cylinder bore;

a rack piston slidably received in said cylinder bore and in meshing engagement with said pinion;

a piston slidably received in said cylinder bore in tandem relationship with said rack piston and having a piston rod slidably received in said rack piston; and adjustable stop means for restricting movement of said piston in opposite directions.

4. A rest apparatus as claimed in claim 3, wherein said adjustable stop means comprises:

a pair of stop bolts screwed into said pair of end cap members to restrict movement of said piston in opposite directions; and a pair of adjusting knobs keyed to said pair of stop bolts to adjust the axial positions thereof.

* * * * *